US007784834B2

(12) United States Patent
Yater et al.

(10) Patent No.: US 7,784,834 B2
(45) Date of Patent: Aug. 31, 2010

(54) CLAMP APPARATUS FOR THREADEDLY CONNECTED TUBULARS

(75) Inventors: Ronald W. Yater, Houston, TX (US); Lawrence E. Wells, Yorba Linda, CA (US); Neil Edward West, Corona, CA (US); Cliff Swiontek, Brea, CA (US); Howard Ervin, Spring, TX (US)

(73) Assignee: Varco I/P, Inc., Houston, TX (US)

( * ) Notice: Subject to any disclaimer, the term of this patent is extended or adjusted under 35 U.S.C. 154(b) by 525 days.

(21) Appl. No.: 11/729,428

(22) Filed: Mar. 28, 2007

(65) Prior Publication Data

US 2008/0238095 A1 Oct. 2, 2008

(51) Int. Cl.
*F16L 55/00* (2006.01)
*E21B 19/16* (2006.01)

(52) U.S. Cl. ..... 285/92; 285/333; 285/420; 173/213; 175/325.1

(58) Field of Classification Search ..... 464/182, 464/49, 88, 154, 18–21, 74, 158, 901; 403/290, 403/359.1, 310, 311, 312; 285/34, 35, 912, 285/913, 914, 39, 420, 92, 333, 334; 173/91, 173/141, 160, 213; 166/77.51, 77.52; 175/325.1–325.7
See application file for complete search history.

(56) References Cited

U.S. PATENT DOCUMENTS 7,530,540 B2 * 5/2009 Long et al. ..... 248/230.1

* cited by examiner

*Primary Examiner*—James M Hewitt
*Assistant Examiner*—Jay R Ripley
(74) *Attorney, Agent, or Firm*—Williams, Morgan & Amerson, P.C.

(57) ABSTRACT

A clamp for clamping to two threadedly-connected items, and, in one aspect, two threadedly-connected components of a top drive system.

12 Claims, 8 Drawing Sheets

Fig. 3A
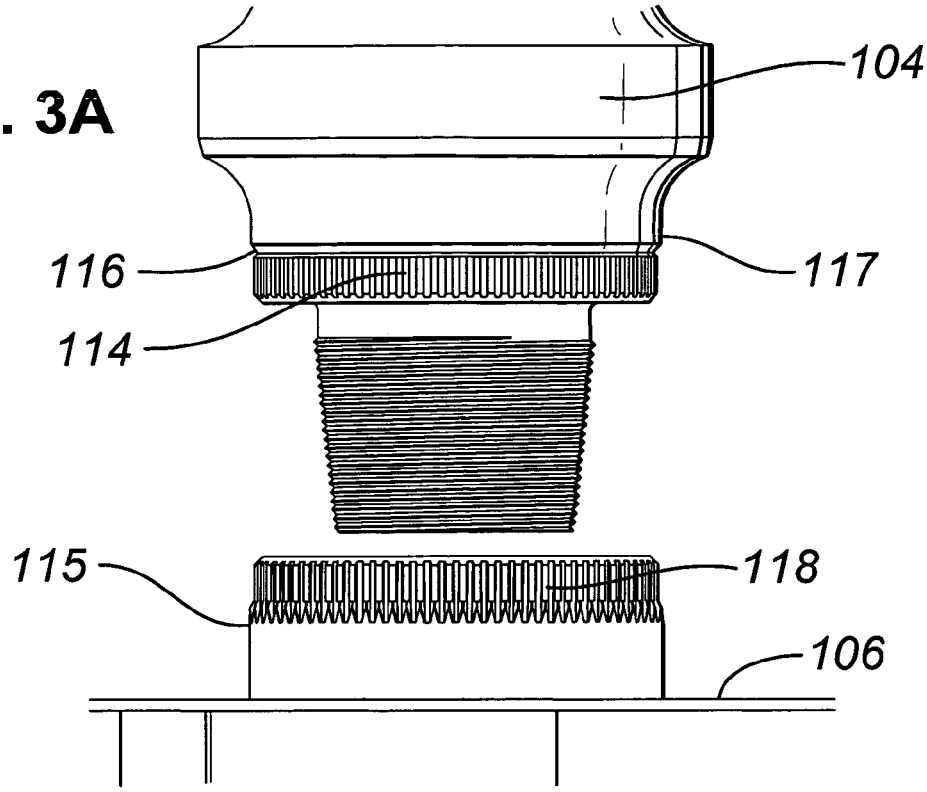
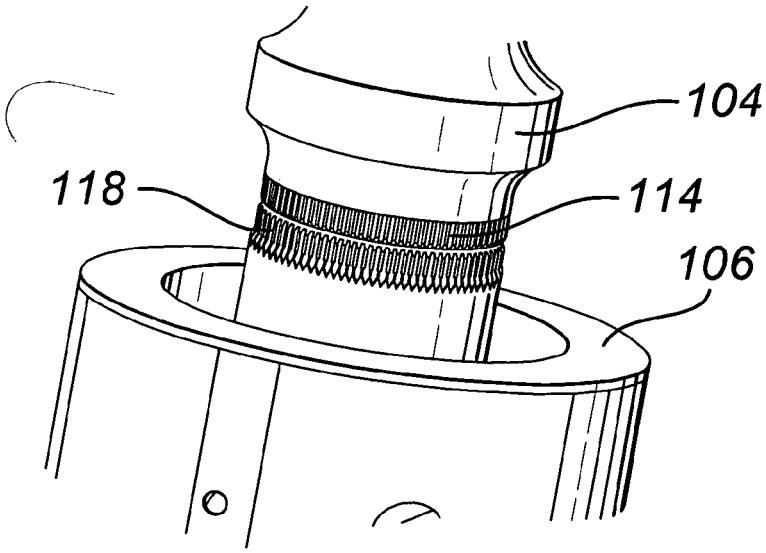
Fig. 3B
Fig. 3C
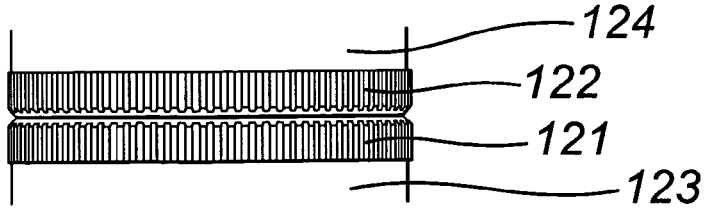

CLAMP APPARATUS FOR THREADEDLY CONNECTED TUBULARS

BACKGROUND OF THE INVENTION

1. Field of the Invention

This invention is directed to clamp apparatuses for clamping together two threadedly connected items or to clamp together a drive shaft of a wellbore top drive system and another item, e.g. mud saver, a saver sub or an internal blowout preventer; to clamp together a mud saver and a saver sub; and methods of their use.

2. Description of Related Art

The prior art discloses a variety of clamping apparatuses for clamping together a top, drive shaft or part of a tubular string below a top drive threadedly connected to another item, e.g. a top drive shaft connected to a mud saver or a mud saver and another item, e.g. a saver sub. For example, and not by way of limitation, a prior art clamping apparatus is disclosed in co-owned U.S. Pat. No. 7,188,686 which shows clamping apparatuses for clamping together, e.g. a top drive system threadedly connected with another item. U.S. Pat. Nos. 4,458,768; 5,433,279; 6,276,450; 4,813,493; 6,705,405; 4,800,968; 4,878,546; 4,872,577; 4,753,300; 6,536,520; 6,679,333 disclose various top drive systems. The cited patents are incorporated fully herein for all purposes.

BRIEF SUMMARY OF THE INVENTION

The present invention, in certain aspects, discloses a clamping apparatus for clamping together two threadedly connected tubulars to inhibit their relative rotation.

The present invention, in certain aspects, discloses a clamp apparatus for clamping two tubulars which are threadedly connected together to inhibit relative rotation of the two tubulars, each of the two tubulars having at least one projection projecting therefrom, the clamp apparatus including a clamp body having an interior surface, and a plurality of projections projecting inwardly from the interior surface of the clamp body for abutting the at least one projection of each of the two tubulars.

The present invention, in certain aspects, discloses a clamp for clamping two tubulars, each of the two tubulars being a component of a top drive system, the two tubulars threadedly connected together, the clamp for inhibiting relative rotation of the two tubulars, each of the two tubulars having at least one tubular projection projecting therefrom, the clamp including a clamp body having an interior surface, and a plurality of clamp projections projecting inwardly from the interior surface of the clamp body for abutting the at least one tubular projection projecting from each of the two tubulars to inhibit rotation between the two tubulars.

The present invention, in certain aspects, discloses a top drive system with a drive shaft threadedly connected to a mud saver or internal blowout preventer. The drive shaft is clamped to the internal blowout preventer with a clamping apparatus according to the present invention. In certain aspects the two items to be connected each have at least one external projection (or a series of them or multiple spaced-apart series of them) which is held by structure of a clamp apparatus. The clamp apparatus clamps around a first projection (one; or more than one projection) on a first item and around a second projection (one; or more than one projection) in a second item so that relative rotation of the two items is inhibited (depending on the amount of play or "slop" between the clamp and the projections) or substantially prevented when there is substantially no such play or "slop." Viewed another way, according to the present invention a tubular (or tubulars) to be threadedly connected together has a recess, hole, or indentation (e.g. a space between two projections) and a projection of a clamp is received and held therein.

The present invention discloses, in certain embodiments, a top drive system with a drive motor; a gear system coupled to the drive motor; a drive shaft coupled to the gear system; and the drive shaft threadedly connected to an internal blowout preventer, the drive shaft and internal blowout preventer ("IBOP") clamped together; and/or such a system with a mud saver or IBOP clamped to a saver sub.

Accordingly, the present invention includes features and advantages which are believed to enable it to advance clamping together of top drive system components. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures.

It is, therefore, an object of at least certain preferred embodiments of the present invention to provide:

New, useful, unique, efficient, non-obvious clamping apparatuses for clamping together threadedly connected top drive system components or tubulars to inhibit, or substantially prevent, their relative rotation;

New, useful, unique, efficient, non-obvious top drive systems with clamped-together parts, e.g., but not limited to a drive shaft and internal blowout preventer and/or a mud saver and saver sub; and methods of their use; and Such clamping apparatuses useful with items, e.g. a top drive shaft and a mud saver, each of which has at least one or a series of external projections which are held by a clamp apparatus according to the present invention.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention or of the claims in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

FIG. 3A is a side view of parts of the system of FIG. 2A shown separated and apart.

FIG. 3B is a perspective view of the parts of FIG. 3A threadedly connected together.

FIG. 3C is a side view of tubulars according to the present invention.

Figure 1A:
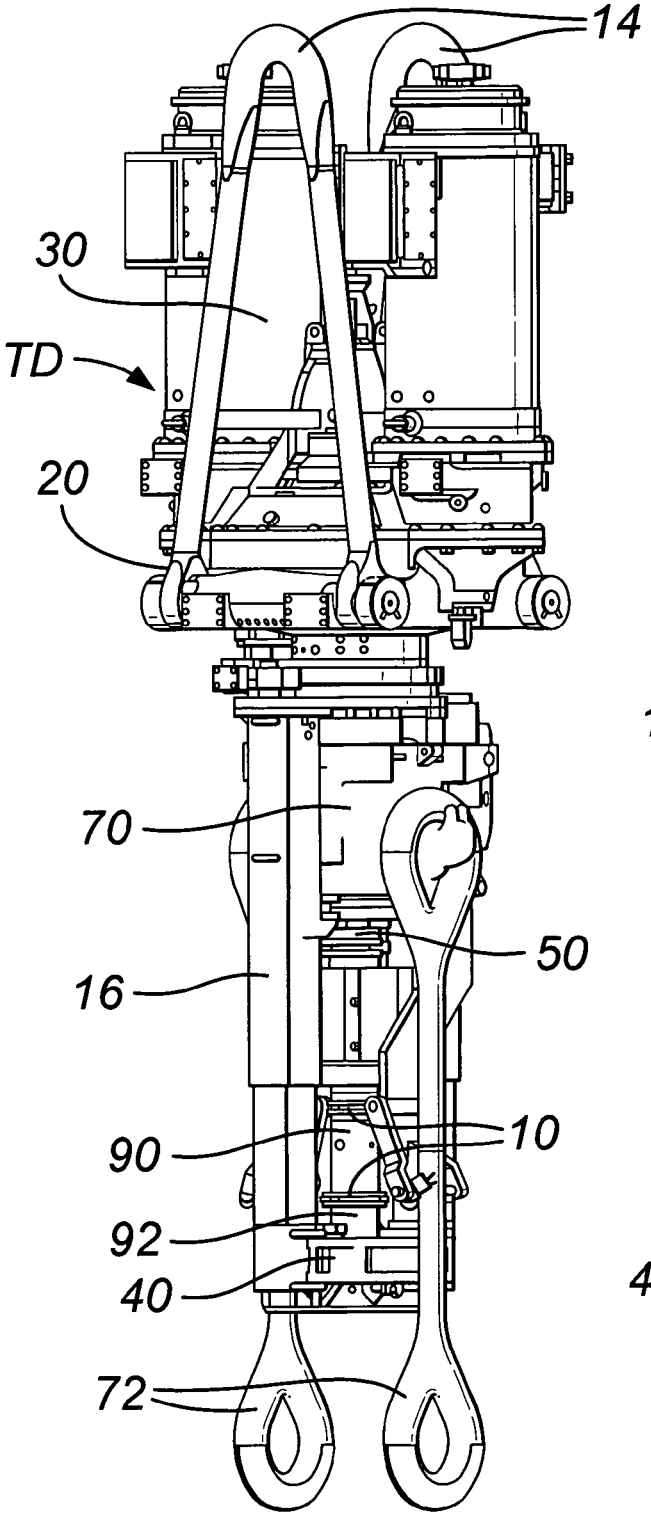
FIG. 1A is a side view of a top drive system according to the present invention.

Presently preferred embodiments of the invention are shown in the above-identified figures and described in detail below. Various aspects and embodiments of the invention are described below are some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION

Figure 1B:
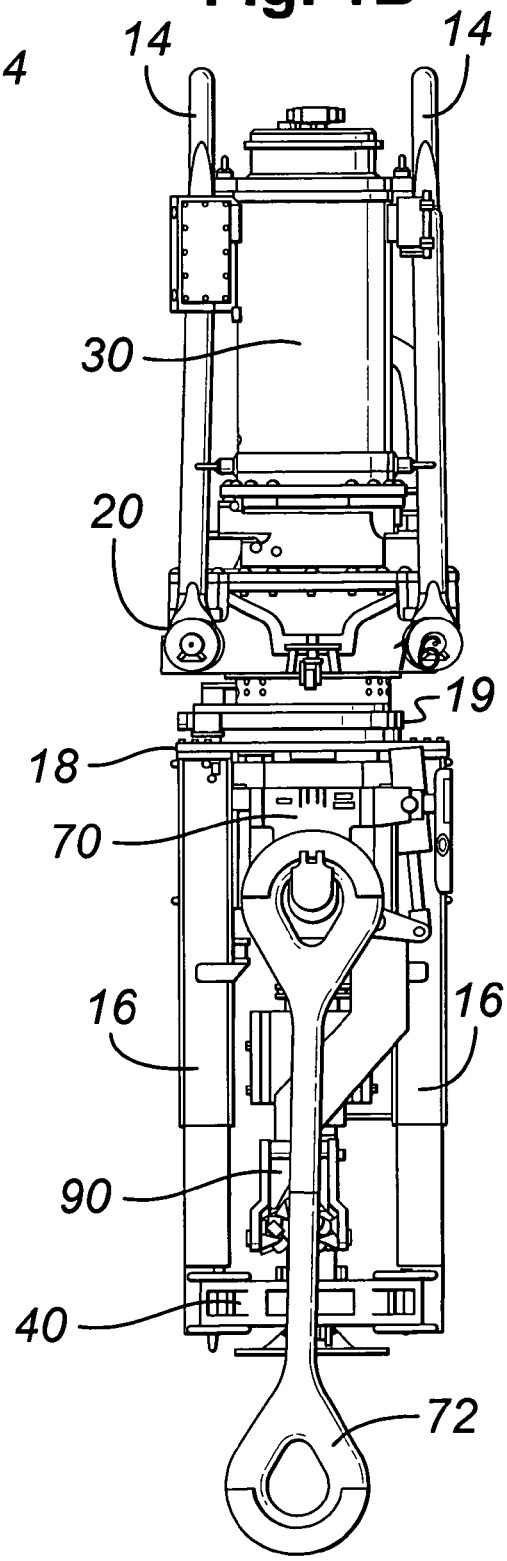
FIG. 1B is a side view of the system of FIG. 1A.

FIGS. 1A and 1B show a top drive system TD according to the present invention which is suspended with links 14 from support such as a becket (not shown) and a travelling block (not shown).

A motor or motors 30 are coupled to a gear system 20. Any suitable motor or motors may be used; e.g., but not limited to, a commercially available alternating current hollow bore permanent magnet motor.

The motor(s) 30 have an output shaft which drivingly meshes with the gear system 20 which mates with a main drive shaft 50. Links 72 suspend an elevator (not shown) from a link adapter 70.

A clamping apparatus 10 according to the present invention clamps together the main drive shaft 50 and an internal blowout preventer assembly 90 (or a mud saver) to maintain a threaded connection between the main shaft 50 and the internal blowout preventer assembly ("IBOP") 90. The IBOP assembly 90 may serve a mud saver function. Optionally, another clamping apparatus 10 according to the present invention clamps together the IBOP assembly 90 and a saver sub 92. Links 72 suspend an elevator (not shown) from a link adapter 70. A gripper assembly 40 is connected to torque legs 16 (two in this case) which in turn are connected to a pipe handler having sub plate 18 below a pipe handler bearing 19.

The clamping apparatus 10 according to the present invention which clamps together the main drive shaft 50 and the IBOP assembly 90 and provides a positive releasable lock of the main drive shaft 50 to the IBOP assembly 90. With the clamping apparatus 10 in place, the top drive cannot unscrew the IBOP assembly 90 from the main drive shaft 50. Thus joints can be made and broken with the top drive system without the main drive shaft 50 separating from the IBOP assembly 90 nor can the top drive system overtorque the connections. After the joint has been torqued to a desired make-up torque an additional torque above the make-up torque must be applied to change the torque setting. The joint clamp will absorb this additional torque so that it can not be transmitted to the joint, regardless of the direction of the additional torque. This is true regardless of the position of the joint on the IBOP stack (group of items with the IBOP).

Figure 2A:
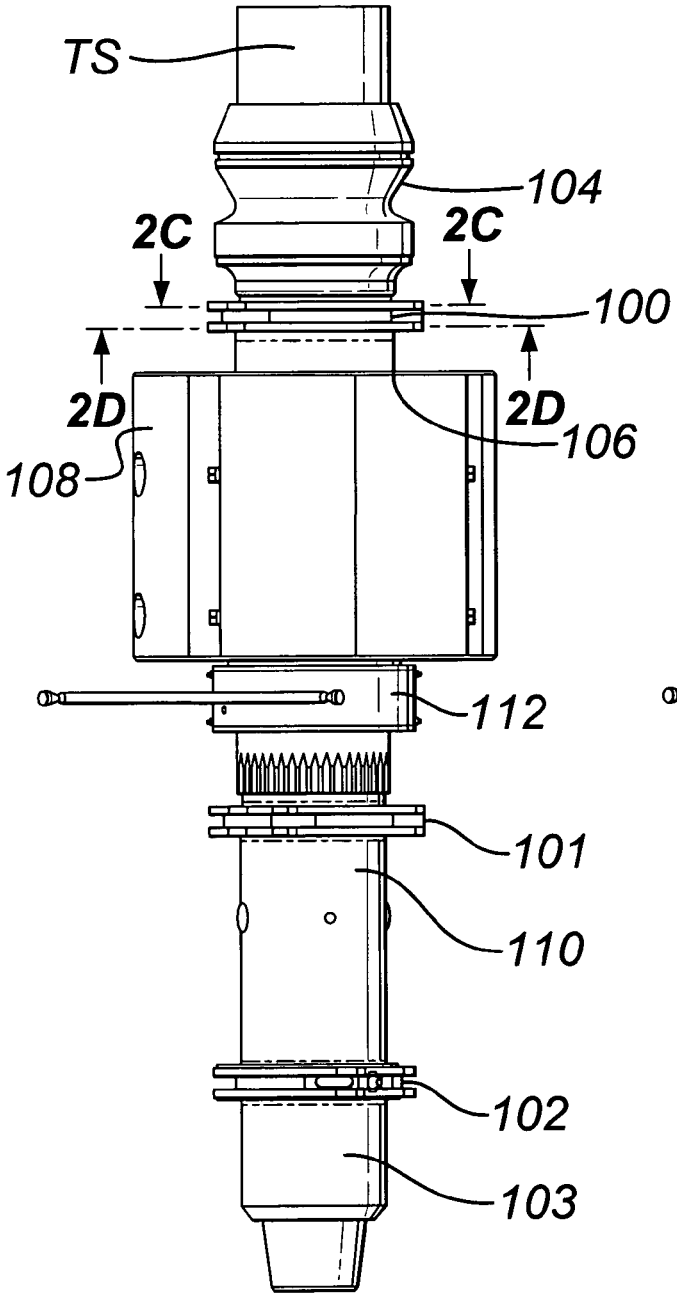
FIG. 2A is a side view of a system according to the present invention with clamp apparatuses according to the present invention.
Figure 2B:
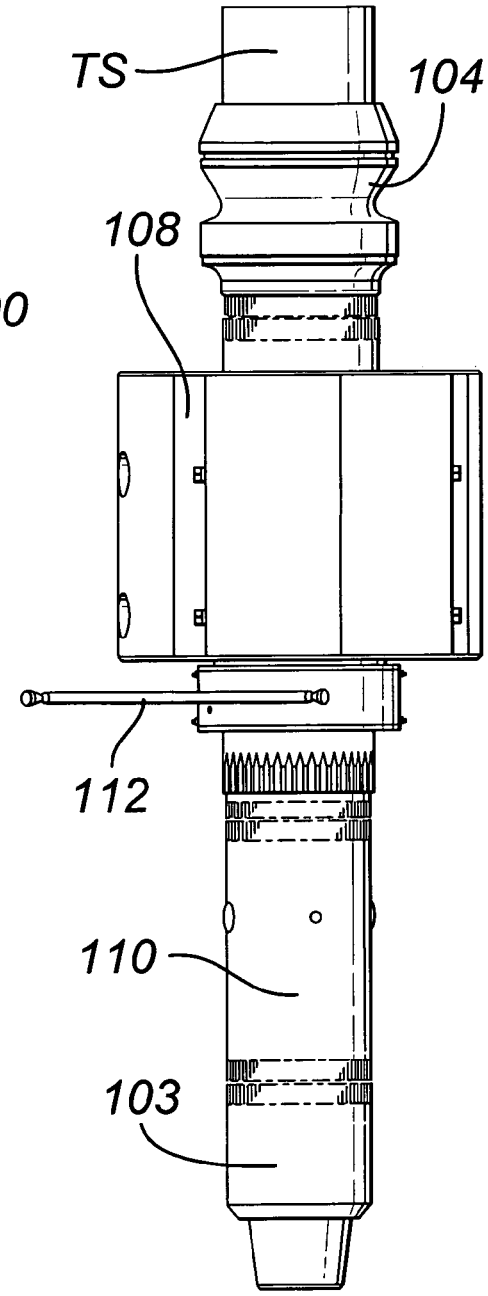
FIG. 2B is a side view that shows the system of FIG. 2B with the clamp apparatuses removed.
Figure 2C:
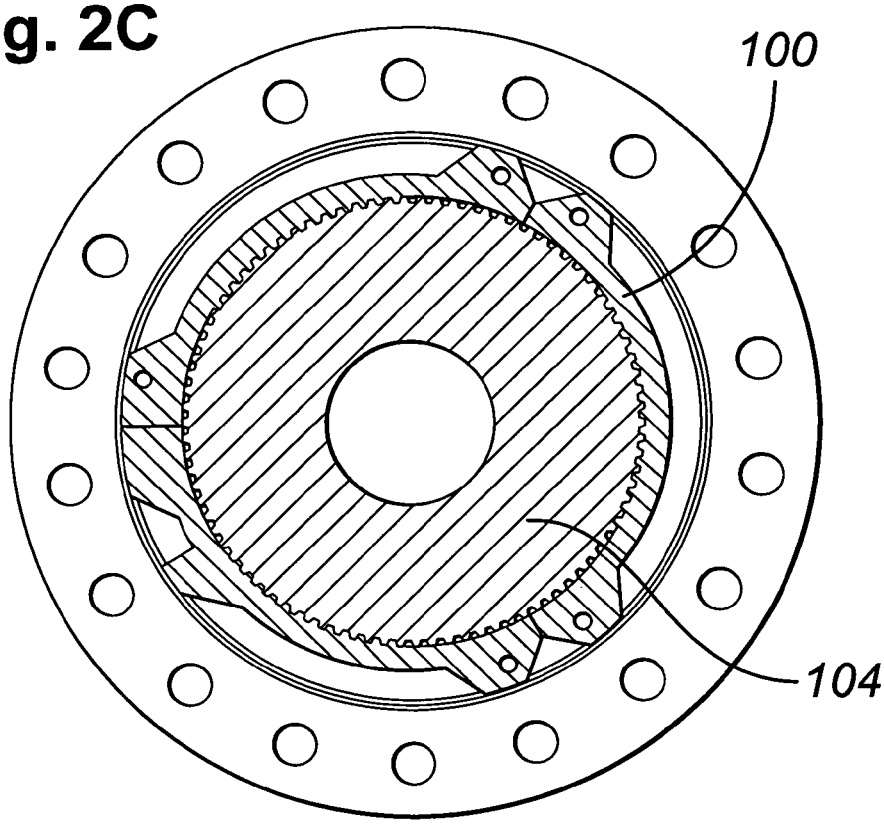
FIG. 2C is a cross-section view along line 2C-2C of FIG. 2A.
Figure 2D:
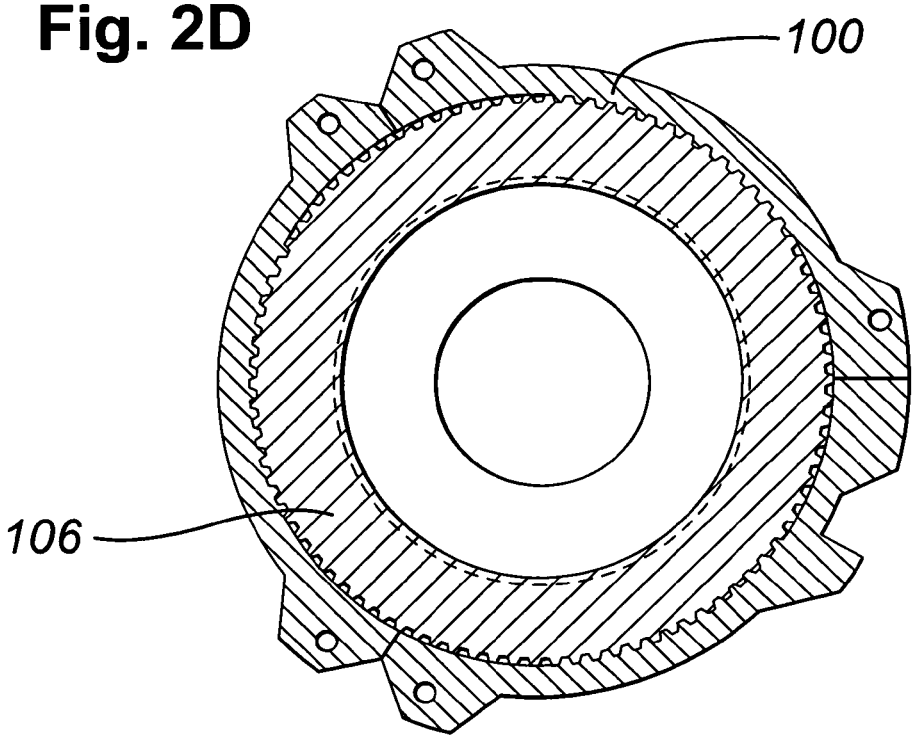
FIG. 2D is a cross-section view along line 2D-2D of FIG. 2A.

FIG. 2A shows clamps 100, 101, and 102 according to the present invention. The clamp 100 clamps together a main shaft 104 of a top drive system TS (shown schematically) to an upper internal blowout preventer 106. The upper internal blowout preventer is actuated, e.g., but not limited to, by using an actuator 108. In this embodiment, an air swivel 112 transfers control fluid for the upper internal blowout preventer's actuator 108 (e.g. from a non-rotating pipe handler (not shown) to the rotating upper internal blowout preventer 106. The swivel 112 can be connected to a support of a gripper (not shown). The clamp 101 clamps together the upper internal blowout preventer 106 and a lower internal blowout preventer 110. The clamp 102 clamps together the lower internal blowout preventer 110 and a saver sub 103. FIG. 2B shows the items of FIG. 2A with the clamps 100, 102, 102 removed.

According to certain aspects of the present invention, each of two tubulars or items to be clamped together with a clamp system according to the present invention has a series of teeth formed of an end thereof. A clamp according to the present invention has corresponding teeth which mesh with the teeth of the tubulars or of the items. With the teeth of the tubulars meshed with the teeth of the clamp apparatus, relative rotation of two threadedly connected tubulars or items is inhibited.

As shown in FIGS. 3A and 3B, the top drive shaft 104 has a series of teeth 114 around its lower end 116 and the upper internal blowout preventer 106 has a series of teeth 118 around its upper end 119. FIG. 3B shows the shaft 104 threadedly connected to the upper internal preventer 106 prior to the installation of a clamp according to the present invention.

It is within the scope of the present invention for the teeth on a tubular to project radially outwardly beyond the surface of the tubular; e.g., see the teeth 122 on the tubular 124 and the teeth 121 on the tubular 123 (see FIG. 3C). optionally, as shown in FIGS. 3A and 3B, the teeth of a tubular can be positioned with respect to the outer surface of the tubular so that the teeth not project radially beyond the tubular's exterior surface. The teeth 114 project to, but not outwardly beyond, a surface 117 of the main shaft 104; and the teeth 118 do not project beyond a surface 115 of the upper internal blowout preventer 106. Such recessed teeth are less likely to be contacted by other objects and apparatuses; e.g., tong jaws or tong dies will be inhibited from contacting these teeth.

Figure 4A:
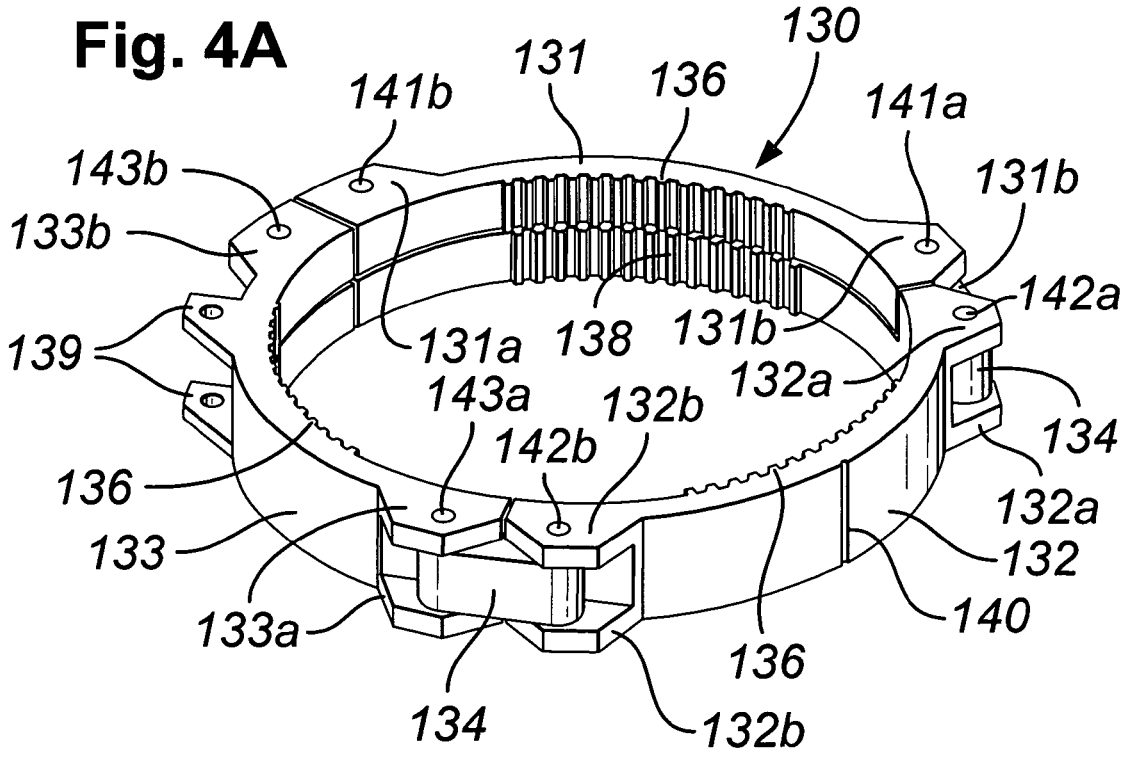
FIG. 4A is a perspective view of a clamp apparatus according to the present invention.
Figure 4B:
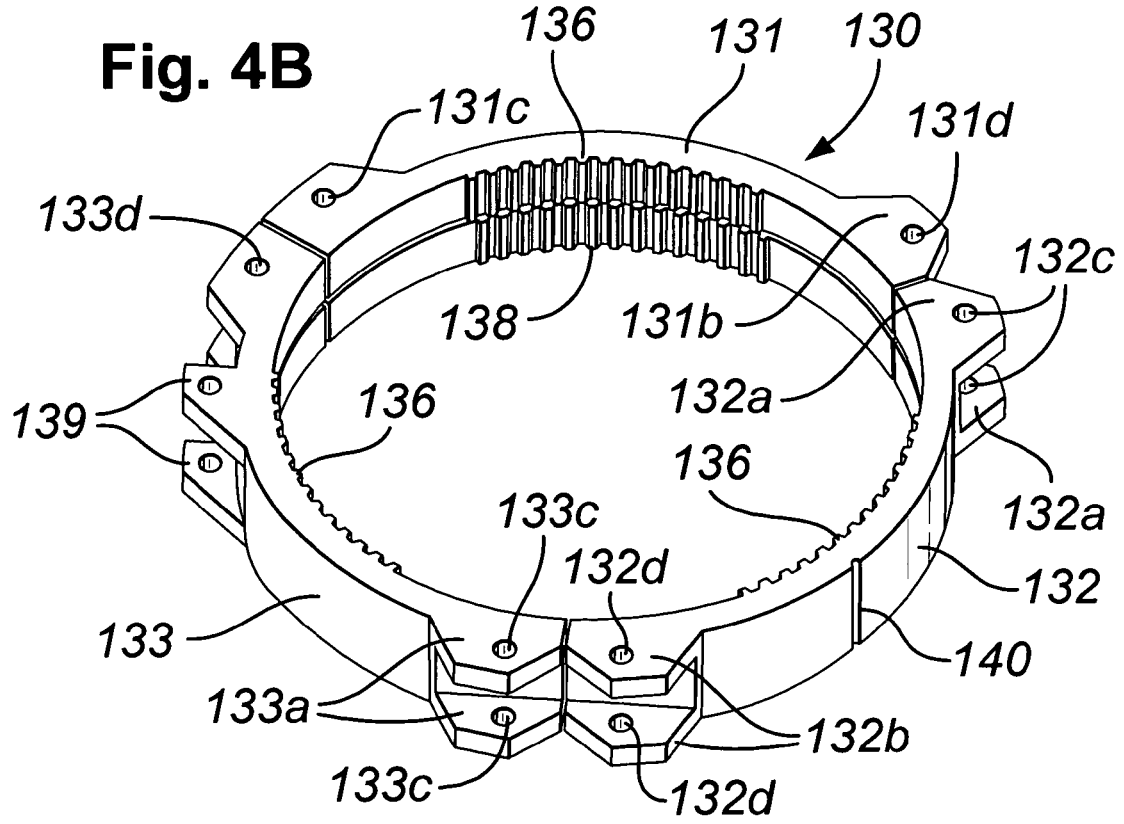
FIG. 4B is a perspective view of part of the system of FIG. 4A.

FIGS. 4A and 4B show a clamp apparatus 130 according to the present invention (which may be used as the clamp apparatuses in any system according to the present invention and in the embodiments of FIGS. 1A, 2, and 3A). The clamp apparatus 130 has three segments 131, 132, 133 which are pinned together with pins 141*a*, 141*b*; 142*a*, 142*b*; and 143*a*, 143*b* which extend through holes 131*c*, 131*d*; 132*c*, 132*d*; 133*c*, 133*d* in pairs of block holders 131*a*, 131*b*; 132*a*, 132*b*; 133*a*, 133*b* and through corresponding holes in connection blocks 134. In one method according to the present invention the segments 131-133 are emplaced against tubulars (or items) to be clamped together so that splines (teeth) on the segments engage splines (teeth) on the tubulars and then the segments are connected together.

The clamp apparatus 130 has an upper series of teeth or splines 136 and a lower series of teeth or splines 138. The teeth 136 mesh with corresponding teeth of an upper tubular which is threadedly connected to a lower tubular. The lower tubular has teeth which correspond to and mesh with the lower series of teeth 138. With the clamping apparatus 130 clamped onto two threadedly-connected tubulars, with the teeth 136 meshed with corresponding teeth of an upper tubular and the teeth 138 meshed with corresponding teeth of a lower tubular, relative rotation between the upper and lower tubular is inhibited. Lugs 139 protect a locking structure 171 (described below).

Figure 5:
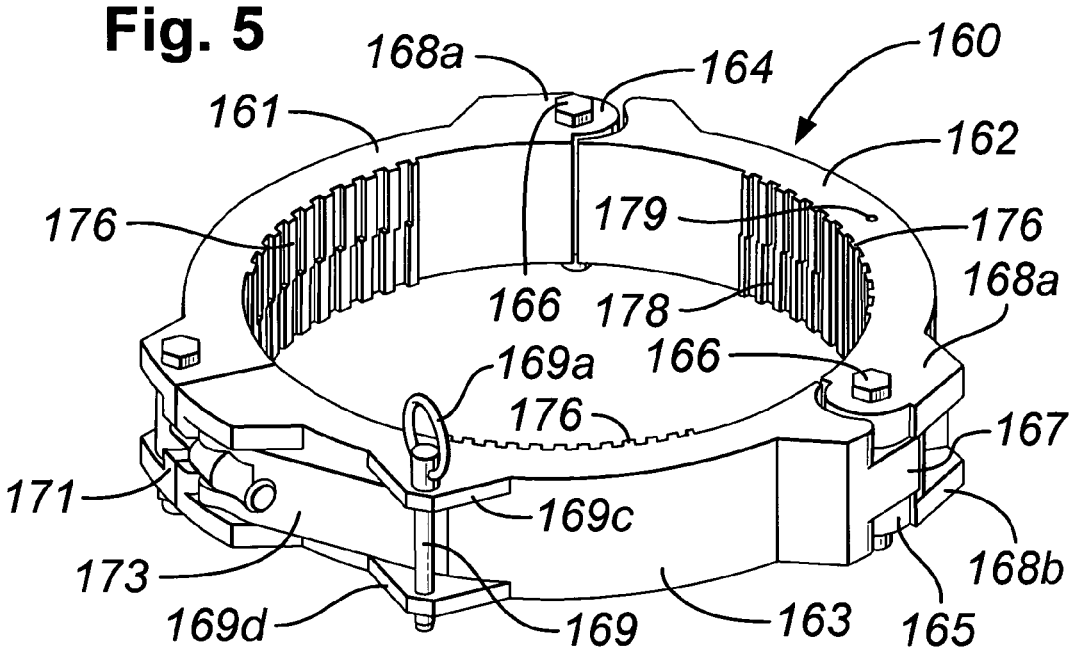
FIG. 5 is a perspective view of a clamp apparatus according to the present invention.

FIG. 5 shows a clamping apparatus 160 according to the present invention which may be used as the clamping apparatus in any system according to the present invention and in the embodiments of FIGS. 1A, 2 and 3A. The clamping apparatus 160 has three hingedly connected segments 161, 162, 163 connected with hinge structures 164, 165. There is an upper series of teeth 176 and a lower series of teeth 178. Each hinge structure 164, 165 has a pin 166 which extends through a member 167 on one segment and through spaced-apart members 168*a*, 168*b* on an adjacent segment. A locking structure 171 releasably holds together the segments 161 and 163. A pin 169 with a pull ring 169*a* extends through lugs 169*b*, 169*c* (like the lugs 139, FIG. 4A) and prevents a toggle clamp lever 173 of the locking structure 171 from rotating out from a latched position. Removal of the pin 169 permits this rotation so the clamping apparatus 160 can be removed from two items that have been clamped together. It is within the scope of the present invention for there to be teeth all around the segments in FIGS. 4A, 4B, and 5, or, optionally, as shown to have teeth radially dispersed on the segments (in certain aspects, to facilitate unclamping, with the radial dispersion not exceeding the pressure angle of the splines or teeth).

The radial positions of two threadedly-connected tubulars is determined by the make-up torque used to connect the two tubulars together. In certain embodiments of the present invention, this means that the tubulars cannot necessarily be connected together to line up the teeth on one tubular with the teeth on another tubular; e.g., if both tubulars of the same outer diameter had the same number of similar teeth, upon connecting the two tubulars to a desired make-up torque the teeth of one tubular might not be aligned with the teeth of the other tubular. Once two tubulars have been threadedly connected to a desired make-up torque, they cannot be further rotated to align teeth on each tubular. In certain embodiments to achieve the alignment of at least one tooth on one tubular with a tooth (or pair of spaced-apart teeth) on another tubular, no matter what the final position of the tubulars, a different number of teeth are used on the tubulars, insuring that at least one tooth on one tubular will align with one tooth (or pair of spaced-apart teeth) on the other tubular when a number N teeth are used on one tubular and a number N−1 teeth are used on the other tubular. By similarly using a different number of teeth for the two series of teeth on the clamp, the teeth of the clamp can mesh relatively easily with the teeth on the tubulars and the clamp will more easily clamp onto the tubulars. For example, referring to FIG. 3A, if the top drive shaft 104 has a number N of teeth 114 and the upper internal blowout preventer 106 has a number N−1 (N minus 1) teeth 118; and a clamp apparatus as in FIG. 4A has a number N teeth 136 and a number N−1 teeth 138, then at the location of alignment of one of the teeth 114 with one of the teeth 118, the clamp can be clamped onto the two tubulars 104, 106 (or, referring to the clamp apparatus 160, FIG. 5, if there are N teeth 176 and N−1 teeth 178) . In certain embodiments if the circumferential arc angle of the segment does not exceed twice the pressure angle of the spline (or tooth), then it is possible to have the splines (or teeth) extend all the way around the clamp. For a 300 pressure angle spline results in six segments. In certain embodiments, the length of segment arc which represent the length of the spline forms per segment, corresponds to a central angle of the segment. To facilitate consistent correct installation and removal of the clamp the central angle of the segment s=does not exceed two times the pressure angle of the spline. Also by thus using, e.g. a 30 degree pressure angle spline (or other suitable angle) the splines (or projections or teeth) of the clamp will not dig into (and possibly lock into) the splines of the tubulars inhibiting or preventing removal of the clamp from the tubulars.

optionally, a visual indicator may be used on a clamp according to the present invention to indicate where on the clamp there are two aligned teeth (one tooth of an upper series of teeth aligned with one tooth of a lower series of teeth); e.g. a line 140, FIG. 4A or a dot 179, FIG. 5).

In other aspects, to achieve tubulars with X number of teeth aligned when the tubulars are threadedly connected to a desired make-up torque, N teeth are provided on one tubular and N−X (N minus X) teeth are provided on the other tubular. For example, to achieve two aligned teeth, one tubular has N teeth and the other tubular has N−2 teeth; to achieve three aligned teeth, one tubular has N teeth and the other tubular has N−3 teeth; and so forth. In the N−2 teeth case, the two pairs of aligned teeth occurs with the pairs diametrically opposed.

Figure 6C:
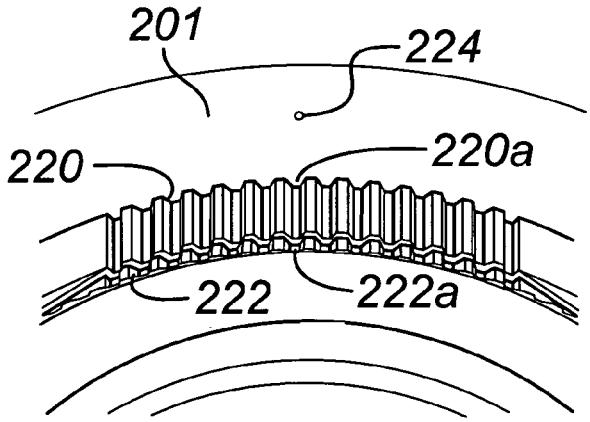
FIG. 6C is an enlargement of part of the clamp apparatus of FIG. 6A.
Figure 6A:
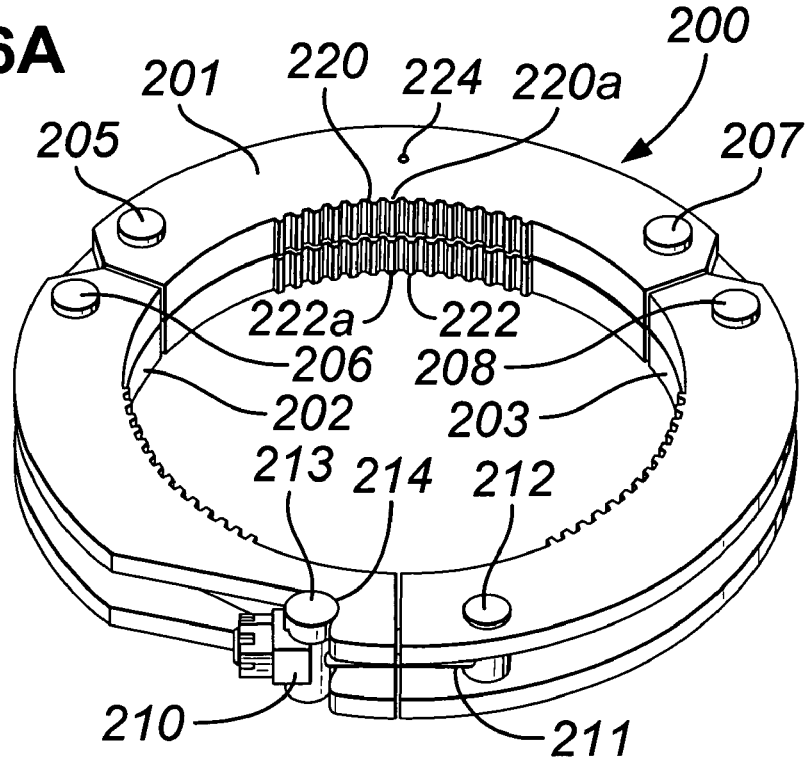
FIG. 6A is a perspective view of a clamp apparatus according to the present invention.
Figure 6B:
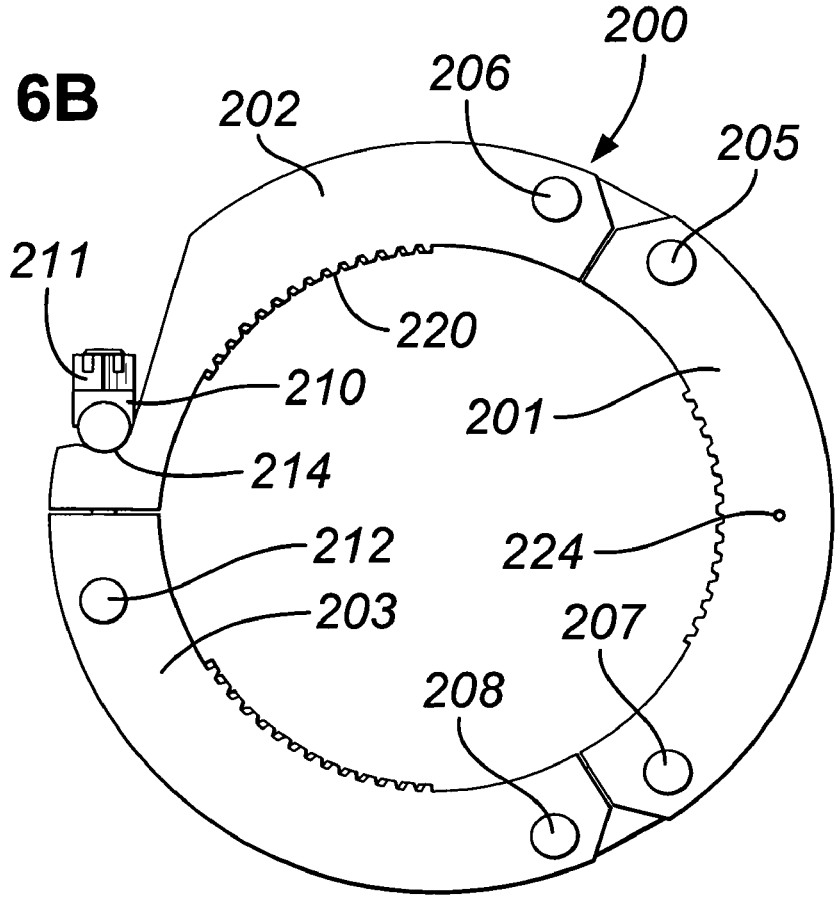
FIG. 6B is a top view of a clamp apparatus of FIG. 6A.

FIGS. 6A-6C show a clamp apparatus 200 according to the present invention which has pinned together segments 201, 202 pinned together with pins 205, 206 and pinned together segments 201, 203 pinned together with pins 207, 208. The segments 202, 203 are releasably locked together with a locking structure 210 which includes a latch bar 211 rotatably mounted with a pin 212 to the segment 203 and a movable lock member 213 which is movable on and securable to the latch bar 211. With the segments 202, 203 in position (as shown in FIG. 6A) the latch bar is rotated so that the movable lock member can be pushed against a recess 214 and secured in place.

Viewed as a whole, the segments 201-203 have N upper teeth 220 and N−1 lower teeth 222. One upper tooth, tooth 220*a*, is aligned with the lower tooth, tooth 222*a*. A visual indicator, e.g. a circle 224, indicates the location of the two aligned teeth.

Figure 7A:
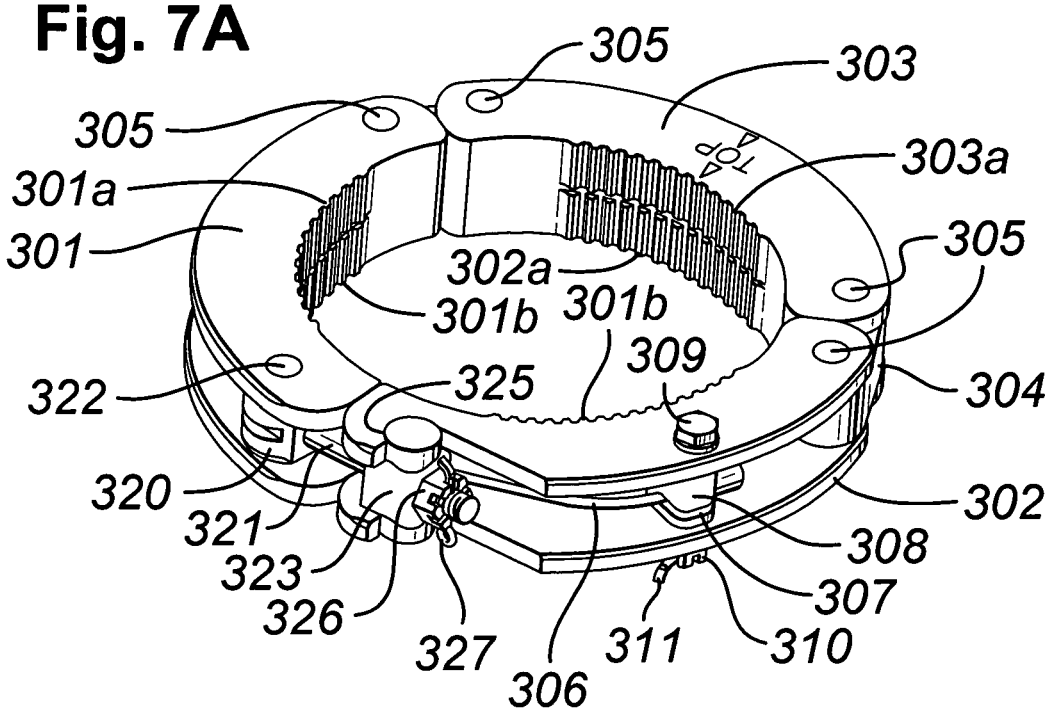
FIG. 7A is a perspective view of a clamp according to the present invention.
Figure 7B:
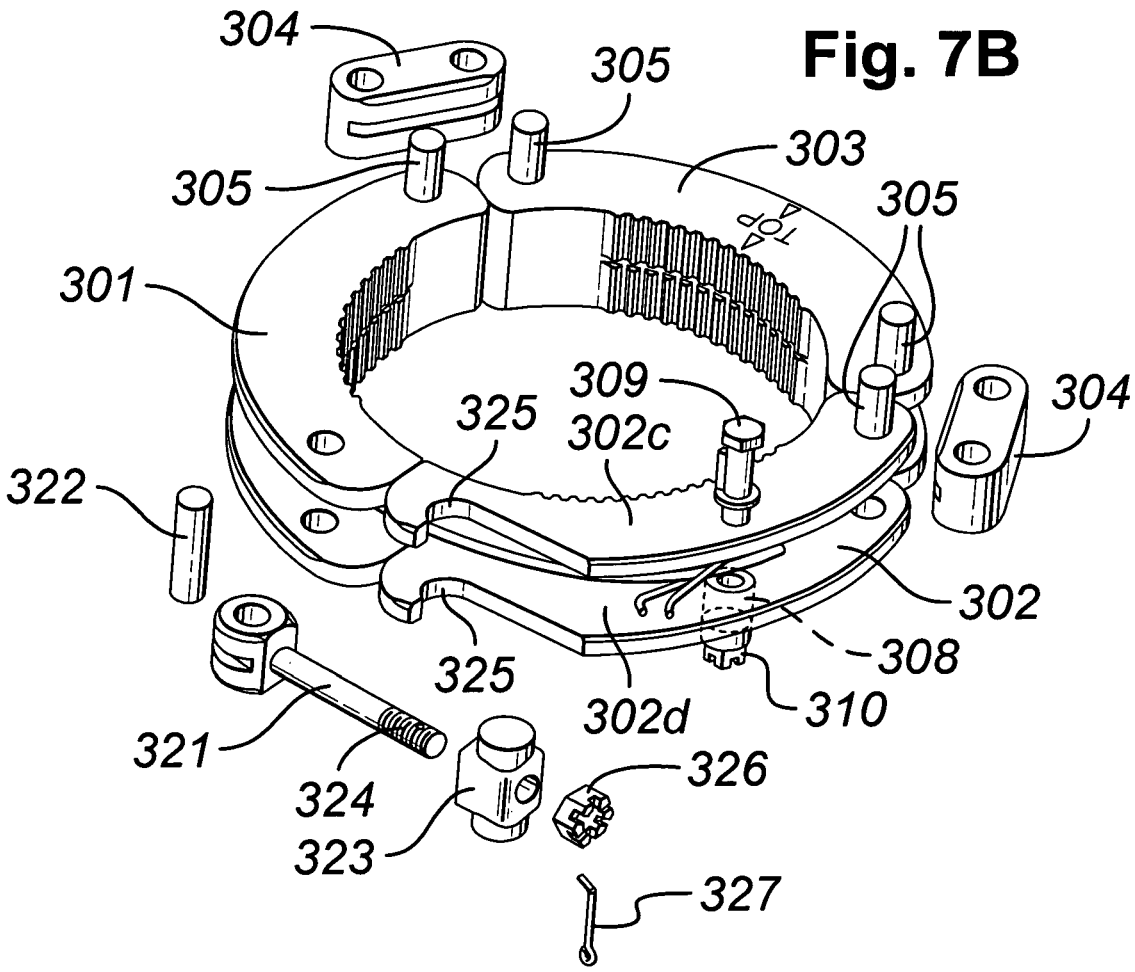
FIG. 7B is an exploded view of the clamp of FIG. 7A.

FIGS. 7A and 7B show a clamp 300 according to the present invention which has three connectible segments 301, 302, 303. A link 304 and pins 305 hold together segments 301 and 303 and segments 302 and 303. Each segment has a top series of teeth (301*a*, 302*a*, 303*a*) and a bottom series of teeth (301*b*, 302*b* shown), all teeth projecting out from interior surfaces of their respective segments.

A releasable lock mechanism 320 releasably secures the segment 301 to the segment 302. Optionally, a safety cable or wire 305 extends around the clamp 300 and its ends are held within recess 307 of a holder 308. Rotating a bolt 309 clamps the cable ends in the holder 308. A castle nut 310 holds the bolt 309 and secures it in place and a cotter pin 311 holds the castle nut 310 in place.

The lock mechanism 320 includes a swing bolt 321 which is pivotably mounted to the segment 301 with a pin 322. A movable locking sleeve 323 encompasses a threaded end 324 of the swing bolt 321. Upon assembly of the segments 301, 302, 303, the movable locking sleeve 323 is moved into recesses 325 of plates 302*c*, 302*d* of the segment 302 and a castle nut 326 is threadedly engaged on and rotated on the threaded end 324 of the swing bolt 321 to releasably hold the swing bolt 321 in place, locking together the segments 301, 302. A cotter pin 329 holds the castle nut 326 in place.

It is within the scope of the present invention to use a projection or projections (tooth, teeth, spline, splines, nub, nubs, finger, fingers, protruding shape or shapes) extending out from the exterior surface of shaft, a cylinder, a tubular, an item which is to be clamped together with another item etc. so that there is limited or no relative rotation between the two items etc. The projection or projections can be of any suitable desired shape or cross-section.

Figure 8A:
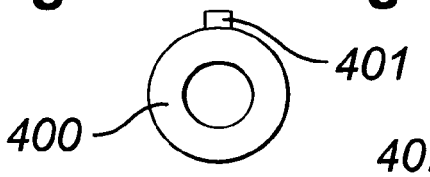
FIG. 8A is a cross-section view of an item according to the present invention.
Figure 8B:
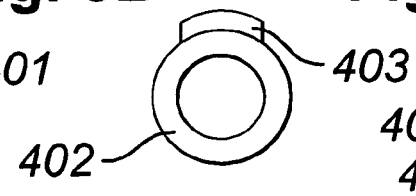
FIG. 8B is a cross-section view of an item according to the present invention.
Figure 8C:
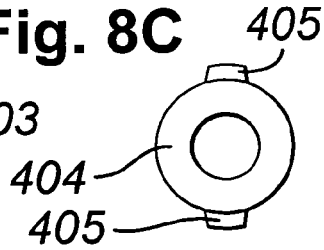
FIG. 8C is a cross-section view of an item according to the present invention.
Figure 8D:
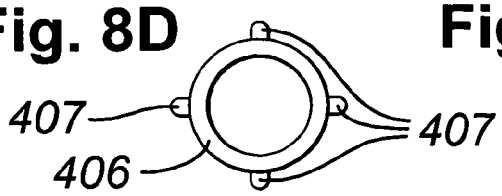
FIG. 8D is a cross-section view of an item according to the present invention.
Figure 8E:
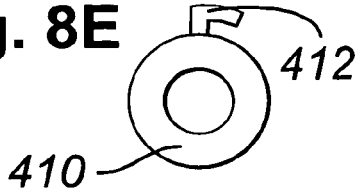
FIG. 8E is a cross-section view of an item according to the present invention.

As shown in FIG. 8A an item 400 has a single projection 401. As shown in FIG. 8B, an item 402 has a single projection 403. FIG. 8C shows an item 404 with two projections 405. FIG. 8D shows an item 406 with four projections 407. FIG. 8E shows an item 410 with a projection 412 which is used with corresponding structure on a clamp. Any item according to the present invention may have one, two, three four or more of any projection shown herein. A clamp according to the present invention to be used with the items of FIGS. 8A-8E will have a corresponding projection or projections for abutting the projection or projections of the item.

In certain aspects clamps according to the present invention and parts thereof, e.g. projections, are intentionally made with clearance tolerances to facilitate application of a clamp to tubulars in at least one position (radially), regardless of the final makeup position of the tubulars.

The present invention, therefore, provides in at least certain embodiments, a clamp for clamping two tubulars, e.g. any two threadedly-connected tubulars or each of the two tubulars being a component of a top drive system, the two tubulars threadedly connected together, the clamp for inhibiting relative rotation of the two tubulars, each of the two tubulars having at least one tubular projection projecting therefrom, the clamp including: a clamp body having an interior surface; a plurality of clamp projections projecting inwardly from the interior surface of the clamp body for abutting the at least one tubular projection projecting from each of the two tubulars to inhibit rotation between the two tubulars. Such a system may have one or some (in any possible combination) of the following: wherein the two tubulars include a first tubular and a second tubular, the first tubular has a first tubular projection, the second tubular has a second tubular projection, and the clamp includes the plurality of clamp projections including a first plurality of clamp projections for positioning adjacent the first tubular projection, a second plurality of clamp projections for positioning adjacent the second tubular projection, and the first plurality of clamp projections above the second plurality of clamp projections; wherein the two tubulars include a first tubular and a second tubular, the at least one projection on the first tubular is a first tubular series of projections, the at least one projection on the second tubular is a second tubular series of projections, the clamp further including the clamp body having a first level and a second level, a first clamp series of projections on the first level, a second clamp series of projections on the second level, the first clamp series of projections for location adjacent and meshing with the first tubular series of projections, and the second clamp series of projections for location adjacent and meshing with the second tubular series of projections; wherein the number of projections of the second clamp series differs from the number of projections of the first clamp series by one; wherein the clamp body is a plurality of clamp segments releasably secured together; lock apparatus for releasably locking together two adjacent clamp segments of the plurality of clamp segments; the two tubulars including a first tubular and a second tubular, the first tubular being a top drive shaft, and the second tubular being an internal blowout preventer; the two tubulars include a first tubular and a second tubular, the first tubular being a mud saver, and the second tubular being a saver sub; and/or the clamp body having an exterior surface, and the plurality of clamp projections projecting outwardly not beyond the exterior surface.

The present invention, therefore, provides in at least certain embodiments, a clamp for clamping two tubulars, each of the two tubulars being a component of a top drive system, the two tubulars threadedly connected together, the clamp for inhibiting relative rotation of the two tubulars, each of the two tubulars having at least one tubular projection projecting therefrom, the clamp including: a clamp body having an interior surface; a plurality of clamp projections projecting inwardly from the interior surface of the clamp body for abutting the at least one tubular projection projecting from each of the two tubulars; wherein the two tubulars include a first tubular and a second tubular, the at least one projection on the first tubular is a first tubular series of projections, the at least one projection on the second tubular is a second tubular series of projections; the clamp body having a first level and a second level; a first clamp series of projections on the first level; a second clamp series of projections on the second level; the first clamp series of projections for location adjacent and meshing with the first tubular series of projections; the second clamp series of projections for location adjacent and meshing with the second tubular series of projections; wherein the number of projections of the second clamp series differs from the number of projections of the first clamp series by one; wherein the clamp body has a plurality of clamp segments releasably secured together; and lock apparatus for releasably locking together two adjacent clamp segments of the plurality of clamp segments. In such a clamp, the first tubular can be a top drive shaft, and the second tubular can be an internal blowout preventer; or the first tubular can be a mud saver, and the second tubular can be a saver sub.

The present invention, therefore, provides in at least certain embodiments, a clamp apparatus for clamping two tubulars which are threadedly connected together to inhibit relative rotation of the two tubulars, each of the two tubulars having at least one projection projecting therefrom, the clamp apparatus including: a clamp body having an interior surface; and a plurality of projections projecting inwardly from the interior surface of the clamp body for abutting the at least one projection of each of the two tubulars.

The present invention, therefore, provides in at least certain embodiments, a method for clamping together two tubulars to inhibit relative rotation between the two tubulars, each of the two tubulars being a threaded component of a top drive system, the two tubulars threadedly connected together, the method including clamping the two tubulars with a clamp, the clamp having a clamp body having an interior surface, a plurality of clamp projections projecting inwardly from the interior surface of the clamp body for abutting the at least one tubular projection projecting from each of the two tubulars. Such a method may have one or some (in any possible combination) of the following: wherein the two tubulars include a first tubular and a second tubular, the at least one projection on the first tubular is a first tubular series of projections, the at least one projection on the second tubular is a second tubular series of projections, the plurality of clamp projections includes a first clamp series of projections and a second clamp series of projections, the method further including meshing the first clamp series of projections with the first tubular series of projections, and meshing the second clamp series of projections with the second tubular series of projections; the two tubulars including a first tubular and a second tubular, the first tubular is a top drive shaft, and the second tubular is an internal blowout preventer; the two tubulars including a first tubular and a second tubular, the first tubular is a mud saver, and the second tubular is a saver sub; the at least one projection on the first tubular is a first series of tubular projections, the at least one projection on the second tubular is a second series of tubular projections, the clamp body having a first level and a second level, a first clamp series of projections on the first level, a second clamp series of projections on the second level, the first clamp series of projections for location adjacent and meshing with the first tubular series of projections, and the second clamp series of projections for location adjacent and meshing with the second tubular series of projections, the method further including meshing the first clamp series of projections with the first tubular series of projections, and meshing the second clamp series of projections with the second tubular series of projections; wherein the number of projections of the second clamp series differs from the number of projections of the first clamp series by one, wherein the number of projections of the first tubular series is the same as the number of projections of the first clamp series by one, and wherein the number of projections on the second tubular series is the same as the number of projections on the second clamp series; and/or the clamp is a plurality of connectible segments, the method further including releasably locking together two of the plurality of connectible segments to releasably lock the clamp to the two tubulars.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. All patent applications and all patents mentioned herein by number are fully incorporated herein for all purposes.

What is claimed is:

1. A top drive system comprising two threadedly connected tubulars, a plurality of longitudinal ridges formed on an outside surface of each of respective mating ends of each tubular, the longitudinal ridges being essentially parallel to the central axis of the respective connected tubulars, the number of longitudinal ridges of each of the two tubulars differing only by one to allow respective longitudinal ridges of a positive, releasable locking clamp to easily mesh with the respective longitudinal ridges on the outside surface of each of respective mating ends of each tubular and to allow the clamp to easily clamp onto the respective longitudinal ridges on the outside surface of each of respective mating ends of each tubular, the positive, releasable locking clamp, the clamp comprising a body with two sets of mating longitudinal ridges on its inside surface that match in number and spacing with respective said longitudinal ridges on the outside surface of each of the respective mating ends of each tubular, the mating longitudinal ridges for clamping together the two tubulars and to prevent relative rotation between the two tubulars, one set of the clamp mating longitudinal ridges are located above the second set of the clamp mating longitudinal ridges.

2. The top drive system of claim 1 wherein the clamp body comprises a plurality of clamp segments releasably secured together.

3. A positive, releasable locking clamp rotationally locking two threadedly engaged tubulars, each of the two tubulars comprising a component of a top drive system, each of the two tubulars having at least one tubular projection projecting therefrom, the clamp comprising:

a clamp body having an interior surface, a plurality of clamp projections projecting inwardly from the interior surface of the clamp body for abutting the at least one tubular projection projecting from each of the two tubulars;

wherein the two tubulars include a first tubular and a second tubular, the at least one projection on the first tubular is a first tubular series of projections, the at least one projection on the second tubular is a second tubular series of projections, the clamp body having a first level and a second level, the plurality of clamp projections having a first series of projections and a second series of projections, the first clamp series of projections on the first level, the second clamp series of projections on the second level, the first clamp series of projections for location adjacent to and meshing with the first tubular series of projections, the second clamp series of projections for location adjacent to and meshing with the second tubular series of projections;

wherein the number of projections of the second clamp series differs from the number of projections of the first clamp series by only one to allow respective projections of the clamp to easily mesh with respective projections on the first and second tubulars and to allow the clamp to easily clamp onto the first and second tubulars;

wherein the clamp body has a plurality of clamp segments releasably secured together and lock apparatus for releasably locking together two adjacent clamp segments of the plurality of clamp segments.

4. The clamp of claim 3 wherein the first tubular comprises a top drive shaft and the second tubular comprises an internal blowout preventer.

5. The clamp of claim 3 wherein the first tubular comprises a mud saver and the second tubular comprises a saver sub.

6. A positive, releasable locking clamp rotationally clamping exposed ends of two threadedly engaged tubulars in a top drive system to prevent relative rotation therebetween, each of the exposed ends of the two threadedly engaged tubulars having at least one tubular projection projecting from outer surfaces of each of the two tubulars, the clamp comprising a clamp body having an interior surface, the interior surface of the clamp secured about the at least one tubular projection on each of the exposed ends of the tubulars, a plurality of clamp projections projecting inwardly from the interior surface of the clamp body for engaging the at least one tubular projection projecting from outer surfaces of each of the two tubulars to inhibit rotation between the two tubulars;

wherein the two tubulars include a first tubular and a second tubular, a number of the at least one projection is on the first tubular and are a first tubular series of projections, a number of the at least one projection on the second tubular and are a second tubular series of projections, the clamp further comprising:

the clamp body having a first level and a second level, the plurality of clamp projections being a first clamp series of projections on the first level and a second clamp series of projections on the second level;

the first clamp series of projections for location adjacent to and meshing with the first tubular series of projections, the second clamp series of projections for location adjacent to and meshing with the second tubular series of projections;

wherein the number of projections of the second clamp series differs from the number of projections of the first clamp series by only one to allow respective projections of the clamp to easily mesh with respective projections on the first and second tubulars and to allow the clamp to easily clamp onto the first and second tubulars.

7. The clamp of claim 6 wherein the clamp body comprises a plurality of clamp segments releasably secured together.

8. The clamp of claim 7 further comprising lock apparatus for releasably locking together two adjacent clamp segments of the plurality of clamp segments.

9. The clamp of claim 7 further comprising lock apparatus for releasably locking together two adjacent clamp segments of the plurality of clamp segments.

10. The clamp of claim 6 wherein the first tubular comprises a top drive shaft and the second tubular comprises an internal blowout preventer.

11. The clamp of claim 6 wherein the first tubular comprises a mud saver and the second tubular comprises a saver sub.

12. The clamp of claim 6 further comprising the clamp body having an exterior surface, and the plurality of clamp projections projecting outwardly not beyond the exterior surface.

* * * * *